US006788270B2

(12) United States Patent
Suprunov et al.

(10) Patent No.: US 6,788,270 B2
(45) Date of Patent: Sep. 7, 2004

(54) MOVABLE ANTENNA FOR WIRELESS EQUIPMENT

(75) Inventors: Peter Suprunov, East Brunswick, NJ (US); Joe Felix, Flanders, NJ (US)

(73) Assignee: Flarion Technologies, Inc., Bedminster, NJ (US)

( * ) Notice: Subject to any disclaimer, the term of this patent is extended or adjusted under 35 U.S.C. 154(b) by 0 days.

(21) Appl. No.: 10/218,148

(22) Filed: Aug. 13, 2002

(65) Prior Publication Data

US 2003/0034924 A1 Feb. 20, 2003

Related U.S. Application Data

(60) Provisional application No. 60/312,427, filed on Aug. 15, 2001, and provisional application No. 60/372,300, filed on Apr. 12, 2002.

(51) Int. Cl.[7] ..... H01Q 1/36
(52) U.S. Cl. ..... 343/866; 343/895; 343/702
(58) Field of Search ..... 343/702, 895, 343/866, 833, 834

(56) References Cited

U.S. PATENT DOCUMENTS 6,052,567 A 4/2000 Ito et al. ..... 455/90
6,054,958 A 4/2000 Holshouser et al. ..... 343/702
6,147,651 A * 11/2000 Yamazaki et al. ..... 343/702
6,154,177 A 11/2000 Saito et al. ..... 343/702
6,400,931 B1 6/2002 Inkinen et al. ..... 455/90
6,501,437 B1 * 12/2002 Gyorko et al. ..... 343/895
6,501,438 B2 * 12/2002 Nevermann et al. ..... 343/895

* cited by examiner

*Primary Examiner*—James Vannucci
(74) *Attorney, Agent, or Firm*—Straub & Pokotylo; Michael P. Straub

(57) ABSTRACT

Antennas and methods of manufacturing and using antennas suited for use in mobile devices are described. The described antennas include an antenna arm (104) and a conical spring radiating element (108) attached to one end of the arm. The spring radiating element (108) is covered by a protective cap (106) and can be compressed to fit inside the cap (106) for easy storage in a PC card. The antenna arm (104) may be implemented as a layered circuit board. In some embodiments the antenna arm (104) includes a radiating element, e.g., a conductive strip (1304), positioned along an edge of the arm (104) which will remain exposed even when the antenna is inserted into a PC card for storage. In various embodiments the spring radiating element (108) automatically extends when the antenna arm (104) is switched from a storage position to an active position, e.g., by pulling on the antenna arm to cause it to slide or swing out of a housing (102).

25 Claims, 8 Drawing Sheets

MOVABLE ANTENNA FOR WIRELESS EQUIPMENT

RELATED APPLICATIONS

The present application claims the benefit of the filing date of U.S. Provisional Patent Application Ser. No. 60/312,427 filed Aug. 15, 2001 titled "SELF RETRACTABLE MAIN ANTENNA ELEMENT AND ANTENNA STRUCTURE FOR PORTABLE RADIO EQUIPMENT" and the benefit of U.S. Provisional Patent Application Ser. No. 60/372,300 filed Apr. 12, 2002 and titled "AN ANTENNA STRUCTURE WITH MOVABLE ARM ANTENNA FOR THE PORTABLE RADIO EQUIPMENT" each of which is hereby expressly incorporated by reference.

FIELD OF THE INVENTION

The present invention is directed to communication devices, and more particularly, to a retractable antennas suitable for use with portable devices, e.g., notebook computers, cell phones, personal data assistants (PDAs), etc.

BACKGROUND OF THE INVENTION

Portable radio equipment such as notebook computers with wireless modems, cellular/cordless phones and other wireless devices are widely used in society. In wireless communication systems, geographic areas are often divided into cells. In each cell, mobile devices can communicate with a base unit in the cell via radio signals. In order to facilitate transmission and/or reception of signals, mobile devices in a wireless system often include an antenna.

For purposes of portability and customer appeal, portable equipment continues to shrink in size. There is a need for antennas suitable for use on portable equipment which are also small in size. In addition to being compact in size, an antenna on a portable device should be light in weight while having desired electrical characteristics such as resonance frequency, bandwidth, and gain.

Existing antennas often include a large number of parts making them complicated and/or difficult to assemble. Due to such complexity they can suffer from reliability problems. Antenna assembly difficulties and the use of a large number of parts can result in antennas that are relatively costly to manufacture.

In order to make portable radio equipment competitive from a cost standpoint, it is desirable to use a low cost antenna which is easy to assemble. The antennas should include relatively few parts, be capable of being manufactured in an automated manner and be reliable when used. Many wireless devices use a high-frequency band ranging from 700 to 2000 MHz. Accordingly, there is a need for a small, light, inexpensive antenna having good transmission and/or reception characteristics in all or a portion of at least the 700 to 2000 MHz frequency range. However, there is also a need for antennas that work well in other frequency bands.

SUMMARY OF THE INVENTION

The present invention is directed to an antenna structure for wireless devices, e.g., personal data assistants (PDAs) and notebook computers with wireless modems, cell phones, and other types of portable radio equipment.

In accordance with the present invention, antennas include an antenna arm and a conical spring radiating element attached to the antenna arm. In various embodiments, the conical radiating element may be protected by a cap and can be compressed to fit within the cap for storage. The antenna of the present invention may be inserted into a PC card for storage when not in use. The ability to compress the spring antenna for storage makes storage within a PC card possible.

In several embodiments, when the antenna is removed from the storage position, the antenna's conical spring radiating element automatically extends as a result of the mechanical spring no longer being constrained by the walls of the PC card.

The antenna arm on which the antenna's conical spring radiating element is mounted may be implemented as a layered circuit board. The spring radiating element is mounted on a first end of the layered circuit board. In some embodiments a middle layer of the circuit board includes a conductive element, e.g., a strip-line, for connecting the conical spring radiating element to a contact located at an opposite end of the antenna arm. The contact is used to couple the antenna to, e.g., receiver/transmitter circuitry.

In various embodiments, a secondary radiating element is incorporated into the antenna arm along an outside edge of the arm. At least a portion of the secondary radiating element remains exposed even when the antenna is placed into a storage position, e.g., inserted into a PC card. In various embodiments a portion of the secondary radiating element is used to couple the primary spring radiating element to the electrical contact used to connect the antenna arm to receiver/transmitter circuitry.

Antennas implemented in accordance with the present invention are simple to implement, have relatively few parts, are light and therefore tend to be well suited for use in mobile devices.

Numerous additional features, benefits and details of the methods and apparatus of the present invention are described in the detailed description which follows.

DETAILED DESCRIPTION

Figure 1:
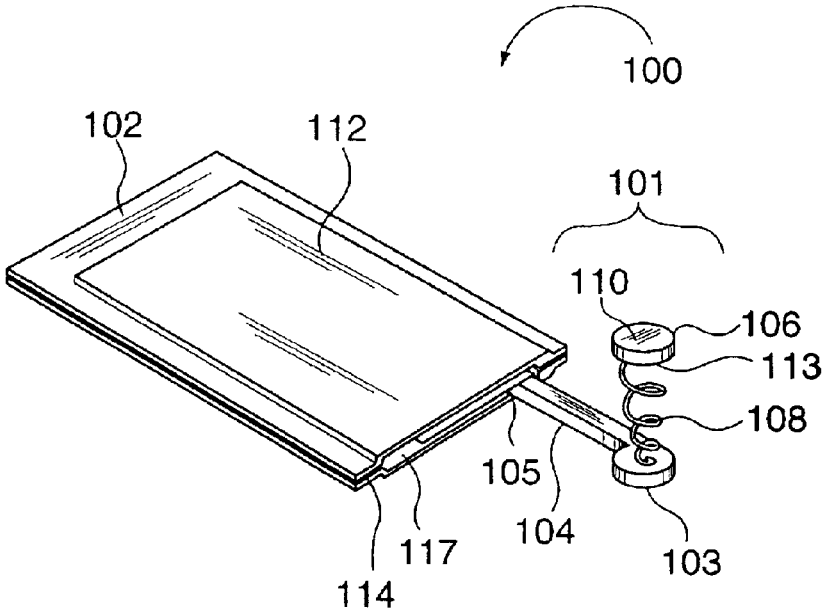
FIG. 1 illustrates an exemplary PC (Personal Computer) card implemented with the antenna of the present invention, in an extended position.
Figure 2:
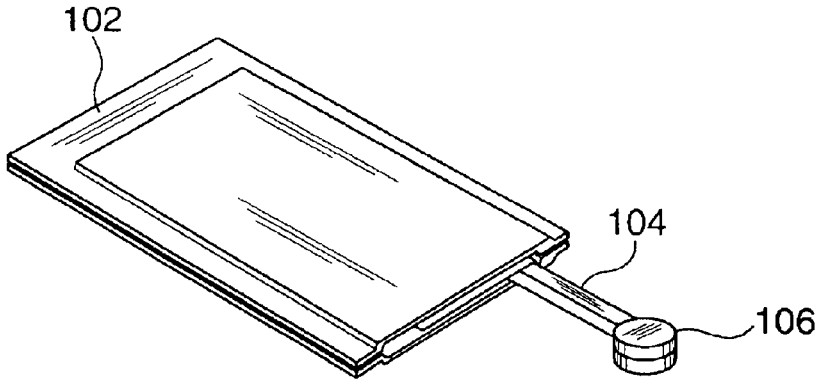
FIG. 2 illustrates the same PC card and antenna as FIG. 1, with the spring radiating element of the antenna in a retracted position.

FIGS. 1 and 2 illustrate a PC card assembly 100 implemented in accordance with a first exemplary embodiment of the present invention.

As shown in FIG. 1, the assembly 100 includes a PC card housing 102 and a movable antenna 101 which can be retracted from or inserted into, the PC card housing 102. The housing 102 includes a top wall 112, a bottom wall 114 and a slot 117. The movable antenna 101 includes a movable antenna arm 104, a coil wire radiating element 108 and a protective cap 106. The arm 104 includes a first end 103 and a second end 105. The coil radiating element 108 is conical in shape and is secured to the first end 103 of the arm 104. To support the radiating element 108, the first end 103 of the arm 104 is wider than the second end 105. The radiating element 108 is formed from a conical shaped spring wire allowing for the element 108 to be stored in a relatively low profile when compressed for storage. Radiating element 108 is mounted, e.g., secured to, the first end 103 of a movable antenna arm 104. Radiating element 108 is topped with a protective cap 106 that is secured to the top, e.g., large end, of the radiating element 108. Protective cap 106 may be made of, e.g., plastic. In one embodiment cap 106 includes a top 110 and a sidewall 113. The inside of the cap 106 may include a slight lip into which the large end of the conical radiating element 108 snaps thereby securing it to the cap 106. Radiating element 108 fits, when compressed, inside cap 106.

The antenna arm 104 is manufactured from a rigid material, e.g., printed circuit board material, and may include multiple layers. The antenna arm 104 includes a conductive element (see FIG. 9 element 1202) which electrically couples a transmitting and/or receiving circuit included in the PC card 102, to the radiating element 108. In this manner, the transmitting and/or receiving circuit included in card housing 102 can receive and/or transmit signals using radiating element 108. The second end of the antenna arm is movably coupled to said PC card allowing the arm 104, and radiating element 108 mounted thereon, to be extended or retracted from the protective card 102. In one embodiment, a pin is used to secure the arm 104 to the card in a manner that allows the arm to swivel so that the arm 104 can swing out of the card 102 when needed. In other embodiments, the antenna 101 is secured to the card 102 in a slidable arrangement wherein it can be slid straight into or out of the card 102.

FIG. 2 illustrates the assembly 100 with the antenna's radiating element 108 in a compressed or retracted position. Note how the conical radiating element 108 fits within the protective cap 106 for easy insertion into housing 102. The conical nature of the element 108 facilitates this compressed storage state since the wire of the radiating element 108 coils up to store in a compact manner.

Figure 3:
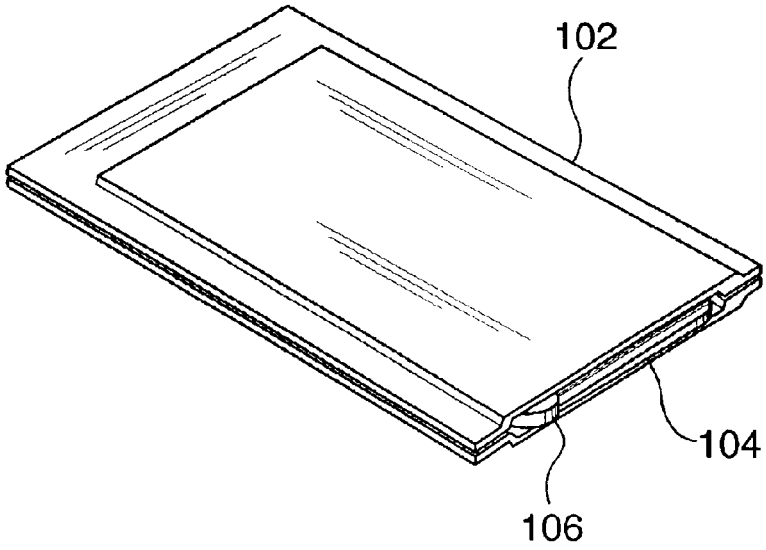
FIG. 3 illustrates the antenna of FIG. 1 as it appears when stored in a PC card.

FIG. 3 illustrates the antenna 101 of the present invention in a storage position in PC card 102. The antenna 101 fits inside the PC card 102 so it is protected. Other mobile devices that use the antenna 101 of the present invention can also be designed with slots into which the antenna can fit. A rotating antenna arm and a protective slot is just one example of the antenna in a storage position. Numerous other techniques for storing the antenna may be used, such as having a slot that a user can push the antenna into, and pull the antenna out from when the user wants to use the antenna.

Figure 4:
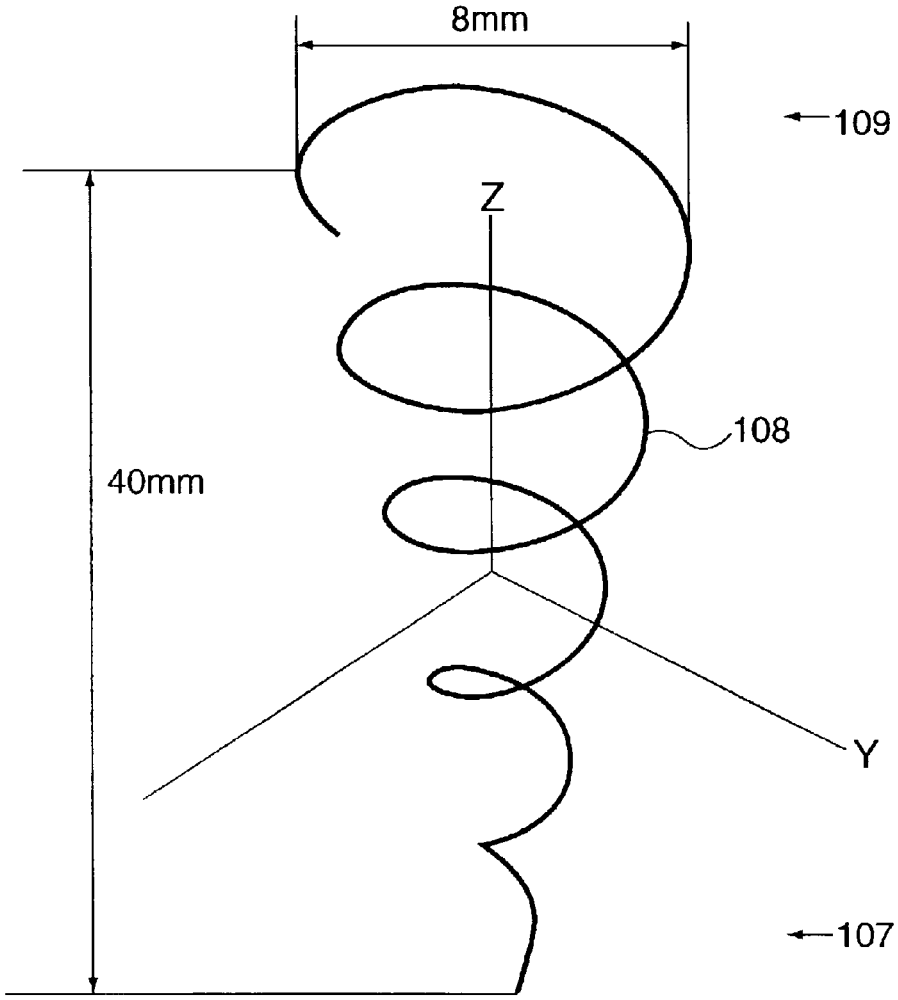
FIG. 4 illustrates a close up view of the antenna radiator element of FIG. 1 in an extended position.
Figure 5:
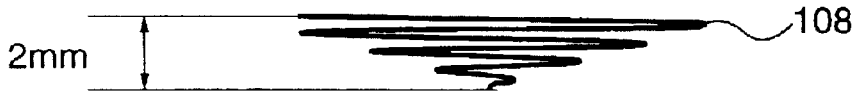
FIG. 5 illustrates a close up view of the antenna radiator element of FIG. 1 in a retracted position.

Detailed views of an exemplary conical radiating element 108 are shown in an extended position and compressed position, in FIGS. 4 and 5, respectively. The exemplary antenna radiating element 108 shown in FIG. 4 is shaped like a cone, expanding in diameter from the bottom 107 to the top 109. In FIG. 4, the largest diameter of the antenna's radiating element 108 at the top 109 of the cone shaped spring coil is 8 mm. The height of the exemplary conical radiating element 108, when extended, is 40 mm. In various embodiments, the maximum diameter of the radiating element 108 is within the range of 4 mm to 200 mm however other maximum diameters are possible.

In the retracted position, the spring coil is compressed from 40 mm to a height of 2 mm, as shown in FIG. 5. In this manner, the antenna is suitable for easy storage when not in use. In some embodiments, a clip or snap is used to keep the spring antenna radiator element 108 in the retracted position. In such an embodiment, the protective cap 106 may snap into a closed position when the spring is compressed to the point where the protective cap contacts the arm 104.

The dimensions shown in FIGS. 4 and 5 of the exemplary spring antenna radiator element 108 are just one example. Actual dimensions of the spring antenna radiator element 108 may be vary with the size being selected to fit the dimensions of the mobile device, and/or PC card, that uses the antenna.

Figure 6:
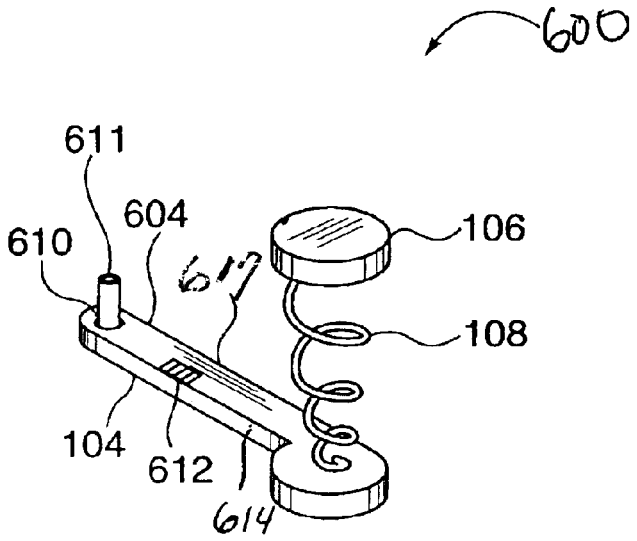
FIG. 6 illustrates a close up view of an antenna implemented in accordance with a swing out storage feature of the present invention.

FIG. 6 illustrates a close up view of a movable antenna 600 implemented in accordance with one particular embodiment of the present invention. The antenna 600 includes an antenna arm position indicator 612 on the arm 104 which is not visible in FIGS. 1 and 2. Pinhole or indention 610 provides a location into which a pin 611 is inserted to mount the antenna 600 into a PC card 102 in various embodiments. The antenna arm position indicator 612 may be a conductive region positioned on the surface of arm 104 at a location which will close an electrical circuit when the arm is retracted into the PC card 102. In FIG. 6, it can be seen that the arm 104 includes an inside edge 614 and an outside edge 617. The position indicator 612 may be positioned on the top or bottom surface of the arm 104.

Figure 7:
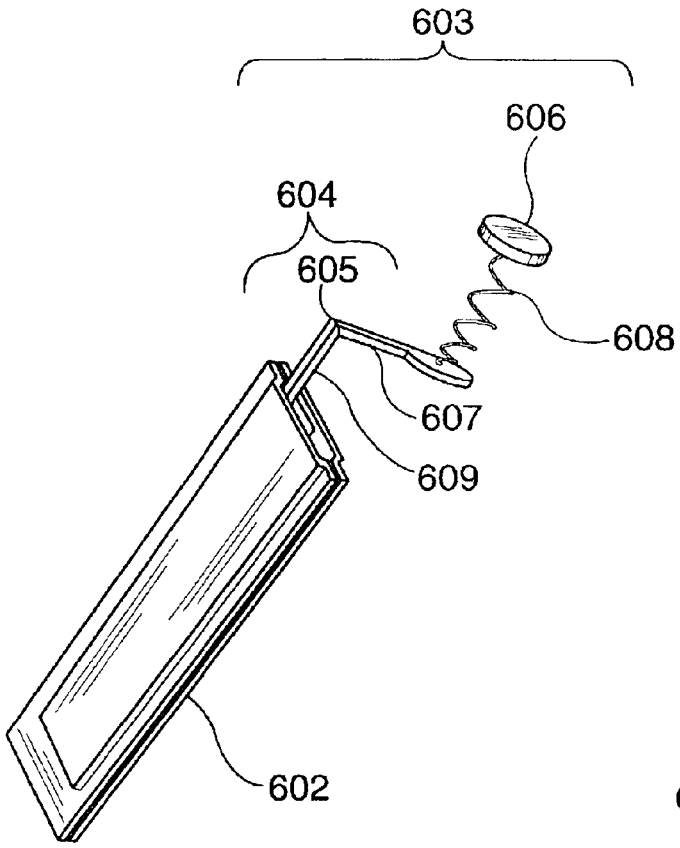
FIG. 7 illustrates a second exemplary PC card with an antenna of the present invention, the antenna having an antenna arm with two sections and an antenna radiator element.
Figure 8:
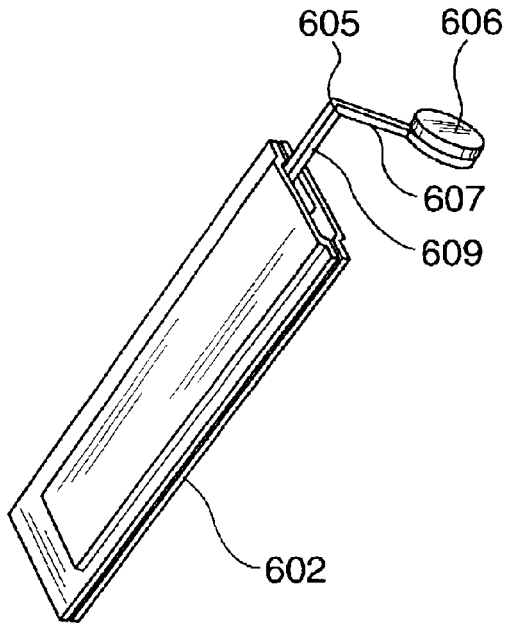
FIG. 8 illustrates the same PC card and antenna as FIG. 6, with the antenna's spring shaped radiating element in a retracted position.

FIGS. 7 and 8 illustrate an additional exemplary embodiment in which antennas are implemented in accordance with the invention. In FIGS. 7 and 8 a stick type housing 602 is used to house communications circuitry to which the antenna 603 is coupled and into which the antenna 603 may be inserted for storage. The antenna 603 shown in FIG. 6 includes a two part antenna arm 609, 607 that include a hinge 605. The antenna 603 also includes a conical radiating element 608 that is topped by protective cap 606.

The hinge 605 allows the second section 607 of the antenna arm 604 to be bent up so that it lies flat with the first section of the arm 609 allowing easy insertion of the arm into the housing 602 for storage. The hinge 605 may lock or snap into the bent position so that the second portion of the arm 607 does not flop around during use. FIG. 8 illustrates the antenna 603 and housing 602 with the conical radiating element in the compressed position.

Figure 9:
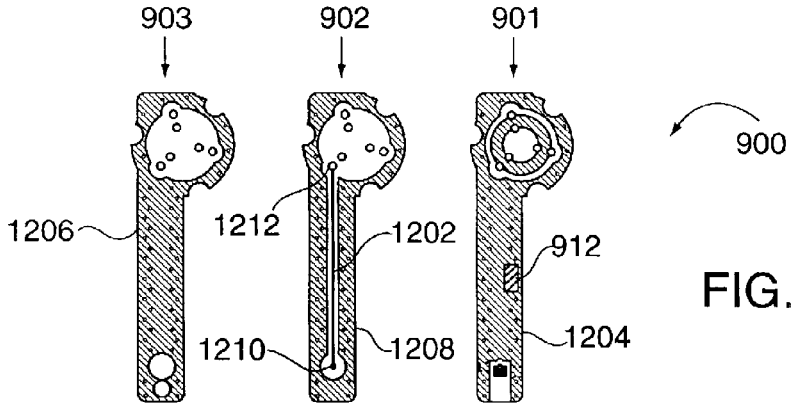
FIG. 9 illustrates three layers of an antenna arm implemented in accordance with a first embodiment of the present invention.
Figure 10:
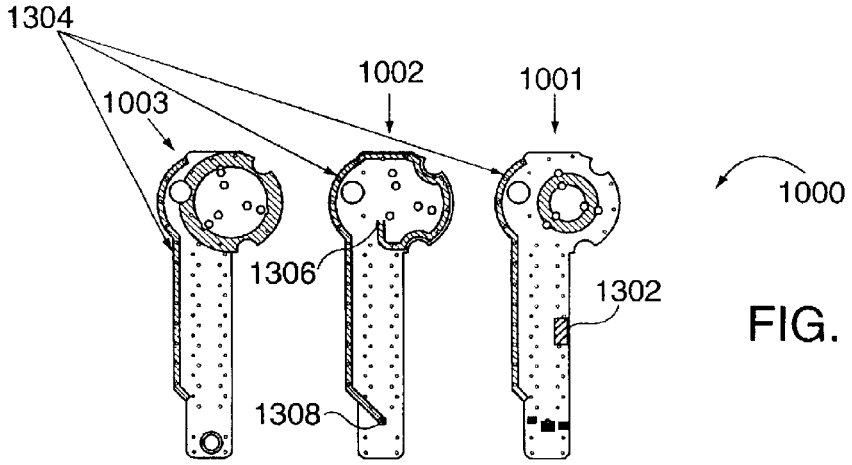
FIG. 10 illustrates three layers of an antenna arm implemented in accordance with a second embodiment of the present invention.
Figure 11:
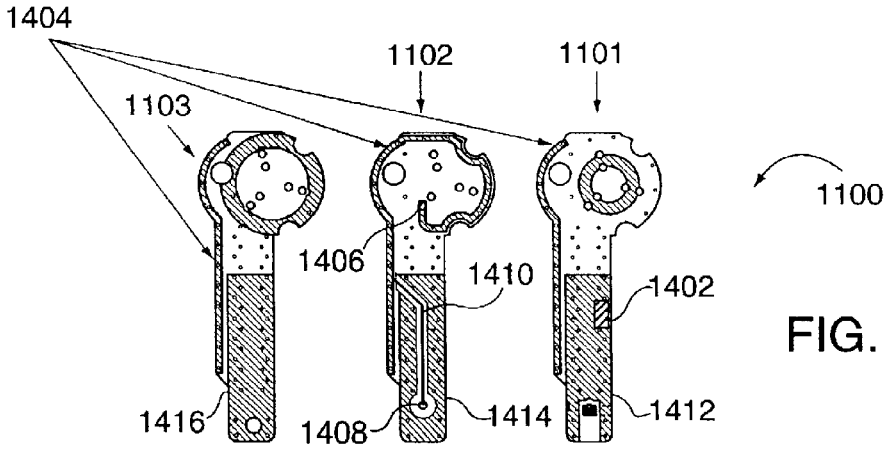
FIG. 11 illustrates three layers of an antenna arm implemented in accordance with a third embodiment of the present invention.

Antenna arms 104 may be constructed from multiple layers of material, e.g., 3 layers, as shown in FIGS. 9, 10 and 11. The layers may be implemented as part of a printed circuit board used to implement the arm 104.

FIG. 9 illustrates the 3 layers 901, 902, 903 of an exemplary antenna arm 104. The three layers 901, 902, 903 may be constructed using copper clad FR-4 printed wiring board material, plated plastic and etched copper, etc. The first, e.g., bottom, layer 901, is made of a grounding element 1204. The first layer 901 includes a conductive area 912 which serves the same function as position indicator 612 of the FIG. 6 embodiment.

The position indicator 912 may be, e.g., a strip of metal, that closes a circuit when the antenna is inserted into a housing thereby indicating to a mobile device that the antenna which includes the arm shown in FIG. 9 is in a storage position. When the arm is pulled out of the storage position, the position indicator 912 will no longer close the circuit and the mobile device will detect that the antenna is in an extended position. Many other techniques may be used for detecting the position of the antenna.

The second layer 902 of the antenna arm shown in FIG. 9 includes a conducting element 1202, e.g., a stripline, which is used to electrically couple the receiver/transmitter circuitry that is using the antenna 900 to the spring antenna radiator element 108 that will be mounted on one end of the antenna arm. Connection point 1212 electrically couples the spring antenna radiator element 108 to the stripline 1202, while connection point 1210 electrically couples the stripline 1202 to the receiver/transmitter circuitry of the mobile device. The stripline 1202 is surrounded by a grounding element 1208. When staked and laminated together between the first and third layers 912, 903, the second layer 902, i.e., the stripline 1202 included therein, will serve as the conductive path by which circuitry in the PC card to which the antenna arm is mounted can interact with the antenna's spring radiating element.

The third layer 903 of the antenna arm shown in FIG. 9 is also made of a grounding material 1206. An antenna arm is formed by pressing the 3 layers 901, 902, 903 together. Once combined in this manner conductive strip-line 1202 is protected from interference by the layers of grounding material surrounding it.

The embodiment shown in FIGS. 1–3 includes a single antenna radiating element, e.g., conical radiating element 108. Unfortunately, when placed in a stored position as shown in FIG. 3, radiating element 108 will be, for the most part, shielded by the housing 102 thereby preventing the reception and/or transmission of signals when the antenna is placed in the stored position.

Figure 12:
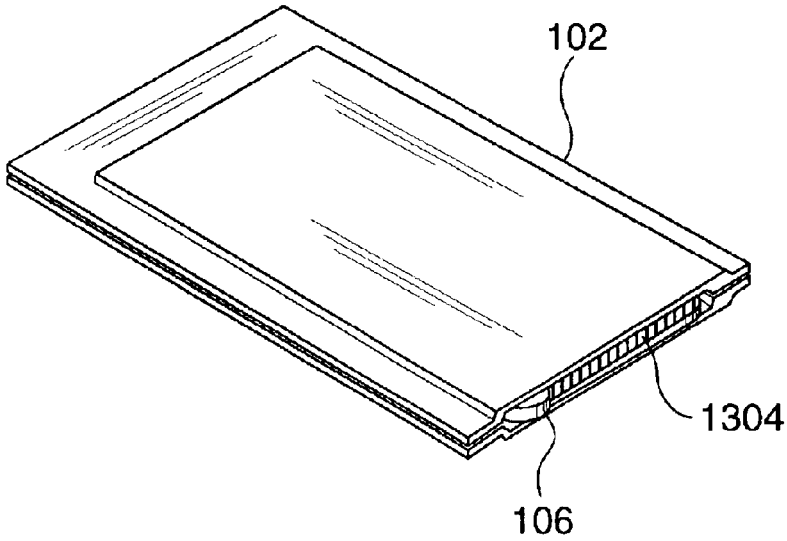
FIG. 12 illustrates the antenna of FIG. 10 as it appears when stored in a PC card.

In order to allow the transmission/reception of at least some signals from an antenna while in the stored position, in accordance with one embodiment of the present invention a second radiating element is incorporated into the antenna arm. This second radiating element remains exposed even when the antenna is positioned in the stored position as shown in FIG. 12. This is because the second radiating element is positioned along the outside edge of the radiating arm which remains exposed even when the antenna is in the stored position. When in the extended position, both the first radiating element, e.g., the conical spring radiating element and the second radiating element will contribute to reception/transmission of signals.

FIGS. 10 and 11 illustrate the layers 1000, 1100 of arms which are directed to embodiments wherein a second radiating element is incorporated directly into the antenna arm to supplement the principal conical spring radiating element which is mounted to the end of the arm. This additional feature of the present invention allows an antenna implemented in accordance with the present invention to send and receive signals while the antenna is in a retracted or a storage position in addition to while the antenna is in the extended position.

FIGS. 10 and 11 illustrate a layered view of two options for implementing antenna arms which include radiating elements. FIG. 10 illustrates an option wherein radiating elements are incorporated into the outside edge of the first through third layers 1001, 1002, 1003 of an antenna arm. Each of the first through third layers 1001, 1002, 1003 in the FIG. 10 embodiment include a conductive radiating element 1304. The first layer 1001 also includes a conductive position indicator 1302. The conductive radiating elements and position indicator are mounted on, and surrounded by, an insulating medium. White areas in FIG. 10 correspond to an insulator while cross-hatched areas correspond to a conductive medium. In the second layer the arm antenna radiator element 1304 is positioned so that it will be electrically coupled to a spring antenna radiator element at connection point 1306 when the conical radiating element is mounted to the arm. The other end of the arm antenna radiator element 1304 of the second layer 1002 couples the antenna to the receiver/transmitter circuitry of a mobile device at connection point 1308. The third layer also includes part of the arm antenna radiator element 1304.

The antenna arm is formed by pressing otherwise stacking layers 1001, 1002, 1003 together. The radiating elements 1304 of each layer operate together as a single radiating element.

In the FIG. 10 embodiment, the arm antenna radiator element 1304 is situated along the left edge of the antenna arm where it will be exposed even when the antenna arm is placed in a closed position as shown in FIG. 12. In general the arm antenna radiator element 1304 should be placed on the edge that will be exposed when the antenna is placed in a storage position.

FIG. 11 illustrates another antenna arm 1100 in which a secondary radiating element is incorporated into the antenna arm. The FIG. 11 implementation includes 3 layers 1101, 1102, 1103. The first layer 1101 includes part of the arm antenna radiator element 1404, a conductive position indicator 1402, and a region 1412 of grounding material. As before the arm antenna radiator element 1404 is placed on the left edge of the antenna arm where it will remain exposed when the antenna is placed in a stored position.

The second layer 1102 includes part of the arm antenna radiator element 1404, as well. In this layer, the arm antenna radiator element 1404 includes electrical connection point 1406 for electrically coupling the arm radiating element 1404 to a primary conical radiating element which is attached to the arm prior to use. A conductive strip line 1410 is incorporated into the second layer 1102 and is used to couple the arm antenna radiator element 1404 somewhere to receiver/transmitter circuitry of a mobile device at electrical connection 1408. The conductive strip line 1410 is surrounded by a grounding material 1414 to shield it from interference. The third layer 1103 includes part of the arm antenna radiator element 1404 and grounding material 1416. When the three layers are pressed together, the conductive strip-line 1410 is surrounded by grounding material to protect it from interference.

The arm antenna radiator elements 1304, 1404 of the FIGS. 10 and 11 embodiments are designed to slightly protrude from the pc card housing 102 when stored. Accordingly, the antenna radiating arms in the FIGS. 10 and 11 embodiments are slightly wider than in the FIG. 9 embodiment.

The electrical antenna parameters, e.g., resonance frequency, bandwidth, etc. of the antenna of the present invention may be similar to, existing conventional antennas.

However, unlike many existing antennas, an antenna of the present invention tends to be small, light, easy to manufacture and is generally well suited for use in mobile devices.

The antenna of the present invention can be manufactured from two parts: 1) a radiator element, e.g., spring coil, and 2) an antenna arm, which may include its own radiator element. Each part can be easily manufactured and combined to form the antenna assembly of the present invention. Therefore, the antenna design can provide, relative to some older known antennas, improved manufacturability, increased reliability, reduced cost, and lower weight.

While the cap 106 is shown in various figures as being circular in shape, other shapes for the protective cap 106 are also possible. In one embodiment, while still being shaped to fit over the spring radiating element 108, the cap 106 is made slightly oblong in shape to allow easier access and alignment. In such an embodiment, the wider portion of the oblong cap is positioned perpendicular to the length of arm 104 facilitating alignment when inserting the arm 104 into slot 117 and providing a surface which can be griped when removing the antenna arm 104 from the slot 117.

The antennas of the present invention can be used in a wide range of devices including portable radio equipment, cell phones, wireless data devices, etc and are not limited to PC card based applications.

It is to be understood that numerous variations on the above described methods and apparatus are possible without departing from the scope of the invention.

What is claimed is:

1. An apparatus, comprising:

a self-supporting coiled wire radiating element; and an antenna arm having a first end, a second end and an electrically conductive element extending in a first direction from said first end to said second end, the coiled wire radiating element being mounted on the first end of said antenna arm in electrical contact with said electrically conductive element, said coiled wire radiating element automatically extending in a second direction when said antenna arm is moved from a first position to a second position, said second direction being substantially perpendicular to said first direction.

2. The apparatus of claim 1, wherein said coiled wire radiating element is conical in shape and includes a small end and a large end, the large end having a maximum circumference that is greater than the circumference of the small end of the coiled wire radiating element, the small end being secured to said antenna arm.

3. The apparatus of claim 2, wherein said antenna arm is substantially flat; and wherein said first end of said antenna arm is wider than said second end of said antenna arm.

4. The apparatus of claim 2, further comprising:

a protective cap mounted to the large end of said coiled wire radiating element.

5. The apparatus of claim 4, wherein the protective cap includes a top and a sidewall, the coiled wire radiating element being stored substantially inside said protective cap and being substantially surrounded by said sidewall when said coiled wire radiating element is in a compressed state.

6. The apparatus of claim 2, wherein said antenna arm is a multi-layered structure including at least three layers, said at least three layers including a bottom layer, a middle layer, and a top layer at least a portion of said electrically conductive element being located on said middle layer.

7. The apparatus of claim 2, wherein said antenna arm includes an inside edge and an outside edge said inside and outside edges extending from said first end to said second end, said antenna arm further comprising:

an arm radiating element positioned along at least a portion of the outside edge of said antenna arm.

8. The apparatus of claim 7, wherein said radiating arm element is electrically coupled to said electrically conductive element.

9. The apparatus of claim 7, wherein said radiating arm element is part of said electrically conductive element.

10. The apparatus of claim 2, further comprising:

a housing, said antenna arm being movably mounted to said housing, said antenna arm being movable from a first storage position in which said antenna arm is substantially enclosed by said housing to a second position wherein said antenna arm extends substantially outside said housing.

11. The apparatus of claim 10, wherein at least a portion of said arm radiating element extends outside said housing when said antenna arm is in said first position.

12. The apparatus of claim 10, wherein said apparatus further comprises:

means for detecting when said antenna arm is in said storage position.

13. The apparatus of claim 12, wherein said means for detecting includes:

an electrically conductive coating covering a portion of at least one of a top and a bottom layer of said antenna arm.

14. The apparatus of claim 10, further comprising:

a protective cap mounted to the large end of said coiled wire radiating element, wherein said protective cap and said coiled wire radiating element fit between a top wall of said housing and a bottom wall of said housing when said coiled wire radiating element is in said compressed state.

15. The apparatus of claim 10, wherein said second end of said antenna arm is mounted to said housing using a pin thereby allowing, said antenna arm to swing out from said housing.

16. The apparatus of claim 15, wherein said housing is a metal personal computer (PC) card housing.

17. The apparatus of claim 1, further including a mobile communications device, said antenna arm being electrically coupled to said mobile communications device.

18. An apparatus, comprising:

a coiled wire radiating element;

an antenna arm having a first end, a second end and an electrically conductive element extending from said first end to said second end, the coiled wire radiating element being mounted on the first end of said antenna arm in electrical contact with said electrically conductive element, wherein said coiled wire radiating element is conical in shape and includes a small end and a large end, the large end having a maximum circumference that is greater than the circumference of the small end of the coiled wire radiating element; and a protective cap mounted to the large end of said coiled wire radiating element, said coiled wire radiating element being substantially outside said protective cap when said coiled wire radiating element is in an extended state.

19. An apparatus, comprising:

a coiled wire radiating element;

an antenna arm having a first end, a second end and an electrically conductive element extending from said first end to said second end, the coiled wire radiating element being mounted on the first end of said antenna arm in electrical contact with said electrically conductive element, wherein said coiled wire radiating element is conical in shape and includes a small end and a large end, the large end having a maximum circumference that is greater than the circumference of the small end of the coiled wire radiating element; and a housing, said antenna arm being movably mounted to said housing, said antenna arm being movable from a first storage position in which said antenna arm is substantially enclosed by said housing to a second position wherein said antenna arm extends substantially outside said housing, wherein said coiled wire radiating element includes sufficient spring tension when in said compressed state to cause said coiled wire radiating element to automatically extend in response to said antenna arm being moved from said first storage position to said second position.

20. An apparatus, comprising:

a coiled wire radiating element;

an antenna arm having, a first end, a second end and an electrically conductive element extending from said first end to said second end, the coiled wire radiating element being mounted on the first end of said antenna arm in electrical contact with said electrically conductive element, wherein said coiled wire radiating element is conical in shape and includes a small end and a large end, the large end having a maximum circumference that is greater than the circumference of the small end of the coiled wire radiating element; and a housing, said antenna arm being movably mounted to said housing, said antenna arm being movable from a first storage position in which said antenna arm is substantially enclosed by said housing to a second position wherein said antenna arm extends substantially outside said housing; and wherein said antenna arm is slideably mounted in a slot in said housing.

21. A communications apparatus for use in a portable communications device, the apparatus comprising:

a housing including a top wall and a bottom wall;

an antenna arm movably mounted to said housing, said antenna arm being movable between a first storage position and a second position;

a coiled wire antenna mounted on a first end of said antenna arm, the first end of said antenna arm being positioned at least partially inside said housing when said antenna arm is in said first storage position and outside said housing when said antenna arm is in the second position; and a protective cap mounted on top of said coiled wire antenna, wherein said coiled wire antenna is substantially outside said protective cap when said coiled wire antenna is in an extended state.

22. The communications apparatus of claim 21, wherein said coiled wire antenna is conical in shape and can be compressed to fit between said top wall and said bottom wall of said housing.

23. The communication apparatus of claim 22, wherein said antenna arm further comprising:

a radiating element extending along at least one edge of said antenna arm, said radiating element being electrically coupled to said coiled wire antenna and being positioned at least partially outside said housing when said antenna arm is in said first storage position.

24. The communication apparatus of claim 23, wherein said protective cap has a recessed portion into which said coiled wire antenna can be compressed prior to moving said antenna arm into said first storage position.

25. The communication apparatus of claim 24, wherein said antenna arm is a printed circuit board.

* * * * *